US006279431B1

(12) United States Patent
Seber et al.

(10) Patent No.: US 6,279,431 B1
(45) **Date of Patent: *Aug. 28, 2001**

(54) SELF-ADJUSTING PLIERS

(76) Inventors: Brett P. Seber, 650 Sheridan Ave., Escondido, CA (US) 92026; Eric B. Carmichael, 210 S. Helix Ave., Apt. L, Solana Beach, CA (US) 92075

( * ) Notice: Subject to any disclaimer, the term of this patent is extended or adjusted under 35 U.S.C. 154(b) by 0 days.

This patent is subject to a terminal disclaimer.

(21) Appl. No.: 09/594,191

(22) Filed: Jun. 14, 2000

Related U.S. Application Data

(63) Continuation-in-part of application No. 09/334,055, filed on Jun. 15, 1999.

(51) Int. Cl.[7] ..... B25B 7/04
(52) U.S. Cl. ..... 81/357; 81/355; 81/367
(58) Field of Search ..... 81/357, 355, 358, 81/359, 360, 361, 364, 342, 367, 368, 370, 372

(56) References Cited

U.S. PATENT DOCUMENTS

| | | | | |
|---|---|---|---|---|
| 2,450,791 | * | 10/1948 | Hagen | 81/372 |
| 2,521,276 | * | 9/1950 | Lampe | 81/380 |
| 3,208,319 | * | 9/1965 | Westby et al. | 81/367 |
| 3,241,410 | * | 3/1966 | Paden | 81/370 |
| 3,379,079 | * | 4/1968 | Cutter | 81/367 |
| 3,672,245 | * | 6/1972 | Hoffman | 81/367 |
| 3,884,100 | * | 5/1975 | Fideldy | 81/367 |
| 4,147,077 | * | 4/1979 | Tasato | 81/367 |
| 4,744,272 | * | 5/1988 | Leatherman | 81/427.5 |
| 5,022,290 | * | 6/1991 | Duffy | 81/355 |
| 5,491,856 | * | 2/1996 | Legg | 7/128 |
| 5,535,650 | * | 7/1996 | McNatt | 81/361 |
| 5,609,080 | * | 3/1997 | Flavigny | 81/368 |

FOREIGN PATENT DOCUMENTS

| | | | | |
|---|---|---|---|---|
| 1264672 | * | 5/1961 | (FR) | 81/358 |

* cited by examiner

*Primary Examiner*—James G. Smith
*Assistant Examiner*—Hadi Shakeri

(57) ABSTRACT

A self-adjusting pliers is operable to grasp a workpiece between an upper jaw and a lower jaw. The pliers includes an upper arm having the upper jaw and a lower arm, with the lower jaw linked to the lower arm but not integral with the lower arm. A control arm has a first end and a second end. The first end of the control arm has a first pivotable connection to the upper arm adjacent to an end of the upper arm remote from the upper jaw, and the second end of the control arm has a second pivotable connection to the lower arm at an intermediate location along the length of the lower arm. An upper control arm pivot pin provides the pivotable connection between the first end of the control arm and the upper arm, and a spring biases the control arm so as to resist rotation of the control arm about the upper control arm pivot pin. A support extends downwardly from the upper arm toward the lower arm and has a guide thereon. The lower jaw slidably engages the guide such that the lower jaw is constrained to follow the guide when the lower arm is pivoted about the upper control arm pivot pin.

18 Claims, 10 Drawing Sheets

SELF-ADJUSTING PLIERS

This application is a continuation-in-part of pending application Ser. No. 09/334,055, filed Jun. 15, 1999, for which priority is claimed and whose entire disclosure is incorporated by reference.

BACKGROUND OF THE INVENTION

This invention relates to pliers, and, more particularly, to a self-adjusting pliers that grips workpieces of various sizes without manual adjustment.

The traditional version of a pliers includes two elongated members joined at a pivot pin. One end of each elongated member forms a jaw, and the other end forms a handle. Workpieces of different sizes are grasped in different manners, due to the constant geometry of the elongated members and the jaws. Some adjustability may be achieved by providing a slotted receiver in one of the handles, so that the handle with the pivot pin may be moved between different positions in the slot to provide adjustability for gripping objects of different sizes.

U.S. Pat. No. 4,651,598 provides an improved pliers whose jaws are self adjusting according to the size of the workpiece. Commercial versions of this pliers are useful, but have important drawbacks. Perhaps the most significant problem with the pliers made according to the '598 patent is that the jaws move relative to each other in an end-to-end manner as they are clamped down onto a workpiece. Soft workpieces such as brass or copper may be marred as a result. The clamping force applied by these pliers depends upon the size of the workpiece being grasped. Additionally, these pliers cannot be locked closed for convenient carrying and storage.

Another problem with the pliers of the '598 patent is that they do not lock to the workpiece, an important convenience in some uses of pliers. Overcenter locking pliers are described in a series of patents such as U.S. Pat. No. 4,541,312. Conventional overcenter locking pliers provide adjustability in the size of the workpiece that may be gripped through a screw adjustment to the pivoting position of the control arm, but this adjustability is not automatic in the sense of the pliers of the '598 patent.

Other types of locking pliers such as the AutoLock™ pliers combine the self-adjusting feature with an overcenter locking mechanism. This pliers can be inconvenient to use for some sizes of workpieces, suffers from some of the problems of the pliers of the '598 patent, does not achieve a large gripping force, and may unexpectedly unlock when large objects are being gripped.

There is a need for a self-adjusting pliers which does not experience shifting of the jaw position as the object is grasped, and which may be provided in a locking version. The present invention fulfills this need.

SUMMARY OF THE INVENTION

The present invention provides a self-adjusting pliers wherein the jaws automatically adjust to various sizes of workpieces. There is no end-to-end relative movement of the jaws as they grasp the workpiece, so that there can be no marring of the type observed with the pliers of the '598 patent. The clamping force is substantially constant regardless of the size of the workpiece, but is adjustable in some versions of the pliers. The clamping force is multiplied several times by the mechanism, leading to a much higher maximum available clamping force than possible with conventional pliers. The pliers may be provided with no locking or with releasable overcenter locking, or with the ability to switch between the two.

In accordance with the invention, a self-adjusting pliers comprises an upper arm including an upper jaw at a first end thereof, an upper handle at a second end thereof, a support extending downwardly from an intermediate location thereof between the first end and the second end, a downwardly extending guide on the support, and a downwardly extending slot on the support, the downwardly extending slot being parallel to the downwardly extending guide. A lower arm includes a first end thereof and a lower handle at a second end thereof. A control arm is pivotably connected at a first end to the upper arm at a location adjacent to the second end of the upper arm, and at a second end to the lower arm at an intermediate location between the first end and the second end thereof. A spring is affixed between the upper arm and the control arm so as to resist rotation of the control arm. A lower jaw member includes a lower jaw at a first end thereof, the lower jaw being in a facing relationship to the upper jaw, and a slider extending from a side of the lower jaw member, the slider being slidable on the guide of the support. A locking engagement is disposed to controllably engage the downwardly extending slot upon pivoting movement of the lower handle to an overcenter position. A shifter has three pivot points arranged in a triangular pattern, the three pivot points being respectively connected to the lower jaw member, to the locking engagement, and to the first end of the lower arm.

The lower jaw member is not part of or rigidly fixed to the lower arm, but is linked to the lower arm by a linkage. The lower jaw member slides in the first slot, so that it necessarily produces a controlled clamping force and clamping direction on the workpiece being grasped. The lower jaw member cannot move in a sideways or end-to-end fashion, thereby overcoming a significant fault in some prior self-adjusting pliers. The locking and clamping force is applied by the user's hand force through the two handles and thence through the locking engagement mechanism acting against the sides of the slot and through the rigid-body pivoting shifter. The two functions of the guiding of the movement of the lower jaw member and the application of force are thus separated to ensure that the movement of the lower jaw member is true.

The guide and the slot may be straight or curved. When they are straight and parallel, the force applied to the workpiece being grasped is approximately constant, but varies slightly for different sizes of workpieces. When they are curved and parallel, it is preferred that the guide slot and the slot are each curved with respective curvatures of substantially constant radius from the upper control arm pivot pin. In this case, the force applied to a workpiece is substantially constant for all sizes of workpieces, an important advantage for some applications.

The maximum magnitude of the clamping force applied to the workpiece may be much larger than possible with conventional pliers, due to four stages of force multiplication present in the mechanism. The length of the handles, the angle between the control arm and the lower arm, the relative location of the shifter pins, and the movement of the shifter relative to the jaw mechanism all contribute to a leveraged four-stage multiplication of the force applied though the handles. The multiplication factors are established by the structural geometry built into the pliers.

The pliers may also be provided with control over the clamping force applied to the workpiece through the jaws. A manual force adjuster acting on the control arm is provided at a location adjacent to the first end of the control arm. The manual force adjuster is operable to move the upper control arm pivot pin of the control arm in a direction along the length of the upper arm. This movement of the first end of the control arm changes its angle and position relative to the lower arm and to the jaw member, with the result that the clamping force applied through the jaws is controllably variable.

In one embodiment, the pliers include a releasable overcenter lock for the jaws. In this version, there is a downwardly extending lobe on the control arm. A release arm is pivotably connected to the lower arm and has a release pad disposed to contact the lobe of the control arm when the release arm is pivoted. In operation, the control arm moves to an overcenter position when the clamping force is fully applied. This overcenter position may be released to unlock the jaws from the workpiece either by pulling the handles apart, or by manually pivoting the release arm. The overcenter locking is readily released by pulling the handles apart when the clamping force is small, but is more conveniently released by operating the release arm when the clamping force is large.

In another version, the pliers is controllably switchable between a non-locking function and a locking function. An overcenter lock switch mechanism in the lower handle is movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching an overcenter lock. The movement of the locking switch mechanism to the second position prevents the pivoting movement of the lower arm and the control arm to an overcenter locking position, and thereby prevents this overcenter locking function.

It is preferred to combine the features of the manual force adjuster and the releasable overcenter lock in a single pliers, when either feature is provided.

The clamping mechanism of the invention is operable to move the lower jaw member upwardly along the downwardly extending guide until the lower jaw contacts the workpiece, thereafter to lock the lower jaw member to the downwardly extending slot, and to transfer a clamping force to the lower jaw. The clamping mechanism is thus self-adjusting to accommodate any size workpiece that will fit between the jaws. The lower jaw member and the lower jaw are constrained to move along the guide, independent of the functioning of the locking feature that operates in conjunction with the slot, ensuring a true movement. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 8–11 are a series of schematic elevational views of a third embodiment of the pliers, in an overcenter locking form, showing the closing movement of the handles and jaws, wherein FIG. 8 shows the jaws in the open position, FIG. 9 shows the lower jaw just contacting the workpiece, FIG. 10 shows the lower handle approaching the overcenter position, and FIG. 11 shows the lower handle in the overcenter position;

FIGS. 12–15 are a series of schematic elevational views of the embodiment of FIGS. 8–11, in a non-overcenter locking form, showing the closing movement of the handles and jaw, wherein FIG. 12 shows the jaws in the open position, FIG. 13 shows the lower jaw just contacting the workpiece, FIG. 14 shows the lower handle approaching the overcenter position, and FIG. 15 shows the lower handle contacting the control arm to prevent movement to the overcenter position;

DETAILED DESCRIPTION OF THE INVENTION

FIGS. 1–17 illustrate a pliers 20 according to the invention. The figures herein are all schematic drawings illustrating external features and internal mechanisms in a single plane, for clarity in describing the interrelationships of the elements. "Up" and "down" reference directions are indicated on several of the figures and apply to all of the embodiments.

Figure 1:
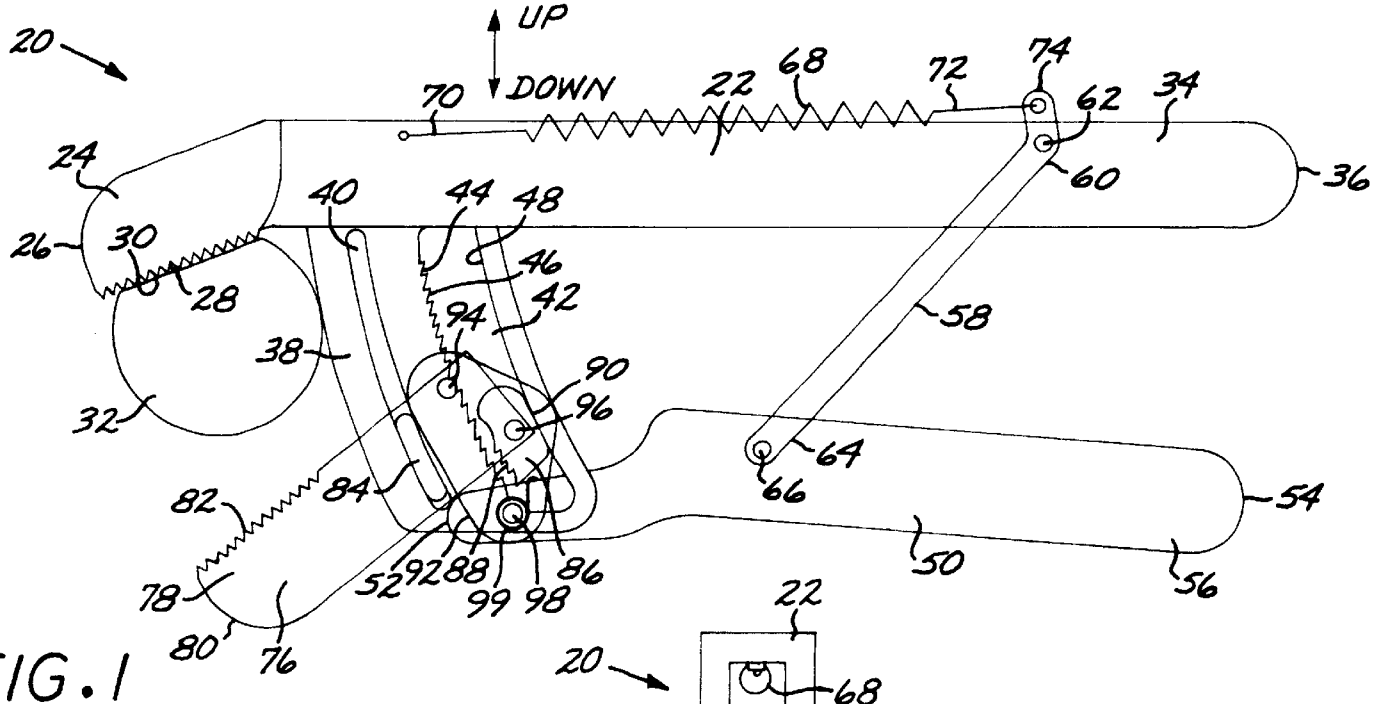
FIG. 1 is a schematic elevational view of a pliers, with the jaws in the fully open position.
Figure 2:
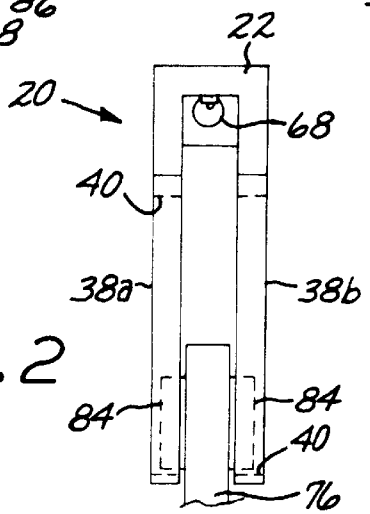
FIG. 2 is a schematic end view of the pliers, from the jaw end.

As shown in FIG. 1 for one embodiment, the pliers 20 comprises an upper arm 22 with an upper jaw 24 at a first end 26 of the upper arm 22. The upper arm 22 has a cross-sectional shape preferably in the form of an inverted "U", with the opening of the "U" pointing downwardly, as seen in FIG. 2. The upper jaw 24 preferably has a pattern of gripping ridges 28 on its lower side 30 for engaging a workpiece 32. An upper handle 34 is at an oppositely disposed second end 36 of the upper arm 22 that is remote from the upper jaw 24. The upper handle 34 is configured for comfortable gripping by a user operating the pliers 20, and may be contoured and/or provided with a resilient plastic covering.

A support 38 is affixed to and extends downwardly from the upper arm 22 at an intermediate location between the first end 26 and the second end 36. The support 38 desirably includes two parallel and spaced-apart support bodies 38*a* and 38*b*, as seen in FIG. 2.

Figure 16:
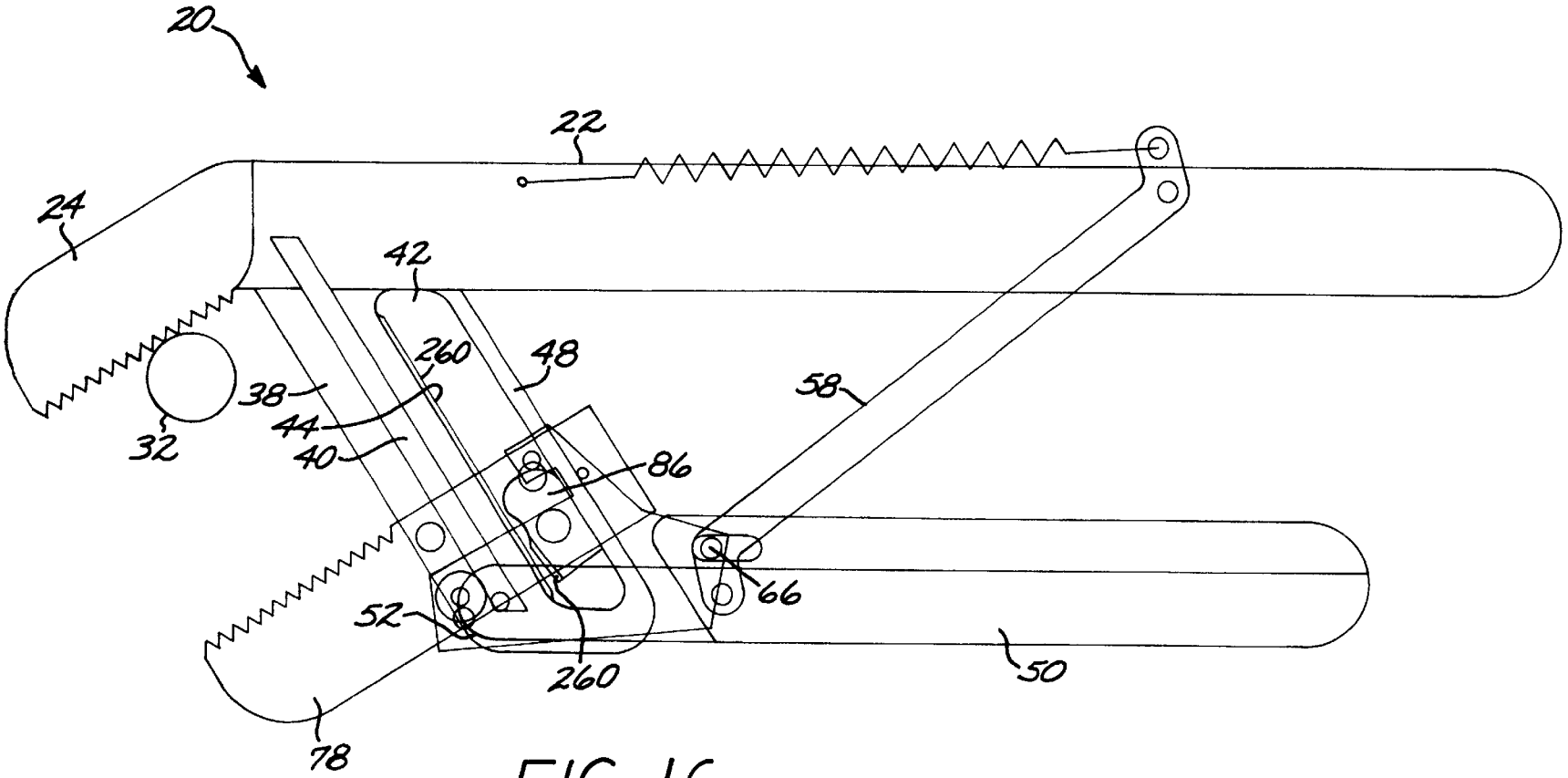
FIG. 16 is a schematic elevational view of a fourth embodiment of the pliers.

Two slots are provided in the support 38, extending through the support bodies 38*a* and 38*b*. A first slot 40 extends downwardly and has smooth side walls. A second slot 42 extends downwardly parallel to the first slot 40, at a location rearward of the first slot and thence closer to the upper handle 34 than the first slot 40. (As used herein, the term "slot" includes other functionally equivalent structures, such as recesses, channels, grooves, and the like, and may include guide surfaces where the function of the slot is to act as a guide as in the case of the first slot 40.) The two slots 40 and 42 are illustrated in FIG. 1 as curved, and the curvature will be discussed subsequently. They are locally parallel to each other, even though curved. That is, the slots 40 and 42 have their adjacent portions substantially parallel to each other. The slots 40 and 42 may instead be straight, as shown in FIG. 16. A first side 44 of the second slot 42, closest to the first slot 40, has second-slot teeth 46 thereon. An oppositely disposed second side 48 of the second slot 42, closest to the upper handle 34, is smooth.

A lower arm 50 has a first end 52 and an oppositely disposed second end 54. The lower arm 50 preferably has a cross section in the form of an upwardly opening "U" shape. A lower handle 56 is present adjacent to the second end 54. As with the upper handle 34, the lower handle 56 is configured for comfortable gripping by a user operating the pliers 20, and may be contoured and/or provided with a resilient plastic covering. Force is applied to the workpiece 32 by the hand of the user of the pliers 20 acting through the two handles 34 and 56.

A control arm 58 is pivotably connected at a first end 60 thereof to an upper control arm pivot pin 62 on the upper arm 22 at a location within or adjacent to the upper handle 34, and adjacent to the second end 36 of the upper arm 22. A second end 64 of the control arm 58 is pivotably connected to a lower control arm pivot pin 66 at an intermediate location between the ends 52 and 54 of the lower arm 50.

A spring 68 is affixed at a first end 70 thereof to the upper arm 22 at a location adjacent to the first end 26 of the upper arm 22. A second end 72 of the spring 68 is affixed to a spring extension 74 of the control arm 58. The spring extension 74 extends beyond the portion of the control arm 58 that is affixed to the upper control arm pivot pin 62, preferably at an angle to the control arm 58. The preferred angle between the spring extension 74 and the control arm 58 is about 45 degrees, although other angles are operable. The spring force of the spring 68 applied through the spring extension 74 serves to resist rotation of the control arm 58, in the clockwise direction in the view of FIG. 1. Other spring configurations are possible to achieve this resisting of rotation of the control arm 58, as will be discussed subsequently.

The mechanisms associated with the upper arm 22, including the first end 60 of the control arm 58, the upper control arm pivot pin 62, the spring 68, and the spring extension 74, are hidden from external view within the interior of the U-shaped upper arm 22. Similarly, the second end 64 of the control arm 58 and the lower control arm pivot pin 66 are hidden from external view within the interior of the U-shaped lower arm 50.

A lower jaw member 76 includes a lower jaw 78 at a first end 80 thereof. The lower jaw 78 preferably has a pattern of upwardly facing gripping ridges 82 thereon. The gripping ridges 28 and 82 are in facing relationship to each other, and serve to grasp the workpiece 32 firmly therebetween.

A slider 84 extends from each side of the lower jaw member 76, as seen in FIGS. 1 and 2. The slider 84 is shaped and dimensioned to be received within, and to slide within, the first slot 40. The first slot 40 thereby serves as a guide. Any other structural component that functionally serves as a guide may be used rather than the first slot 40. Groves, guide surfaces, and channels are examples. The slider 84 is straight where the first slot 40 is straight, and is curved to match the curvature of the first slot 40, when the first slot 40 is curved. The slider 84 is dimensioned so that its fit into the first slot 40 is sufficiently loose to prevent binding of the slider 84 to the sides of the first slot 40 during operation. The slider 84 constrains the movement of the lower jaw 78 so that it has a perpendicular or near-perpendicular incidence to the upper jaw 24 when the workpiece is grasped between the jaws. This constraint prevents any end-to-end or side-to-side relative movement of the jaws 78 and 24, which would tend to gouge the workpiece. This constraint is an important advantage of the present invention, achieved with the use of two slots 40 and 42 rather than a single slot.

A pawl 86 is captured within and disposed within the second slot 42 of each of the support bodies 38*a* and 38*b*. (That is, there are preferably two pawls 86, but one pawl would be sufficient for the pliers to operate.) Each pawl 86 has a set of pawl teeth 88 thereon, in facing relationship to the second slot teeth 46. A second side 90 of the pawl 88, oppositely disposed from the pawl teeth 88, is smooth and in facing relationship to the smooth second side 48 of the second slot 42. The functioning of the pawl 86 will be subsequently discussed in relationship to FIGS. 3–6. In equivalent structures to be discussed subsequently, a high-friction material may substitute the teeth 46 and 88, or a cam may substitute for the pawl 86.

A shifter 92 is a plate that transfers force applied to the handles into the lower jaw 78. There may be two plate shifters 92, one associated with each of the support bodies 38*a* and 38*b*. Equivalently, there may be a single shifter 92 disposed between the two support bodies 38*a* and 38*b*. Each shifter 92 has three pivot points thereon arranged in a triangular pattern. The three pivot points on the shifter 92 are respectively connected to a lower jaw member pivot pin 94 on the lower jaw member 76, a pawl pivot pin 96 on the pawl 86, and a lower arm pivot pin 98 at the first end 52 of the lower arm 50. The shifter 92 provides the interconnection between the lower arm 50, the pawl 86, and the lower jaw member 76. That is, the lower jaw member 76 is not integral with the lower arm 50, but instead is linked by a linkage, in this embodiment provided by the shifter 92.

A torsion spring 99 is wound around the lower arm pivot pin 98 and anchored on the lower arm 50. The torsion spring 99 resists rotational movement of the lower arm 50 relative to the lower arm pivot pin 98. As will be discussed subsequently, functionally equivalent springs may be used instead of the torsion spring 99.

Figure 4:
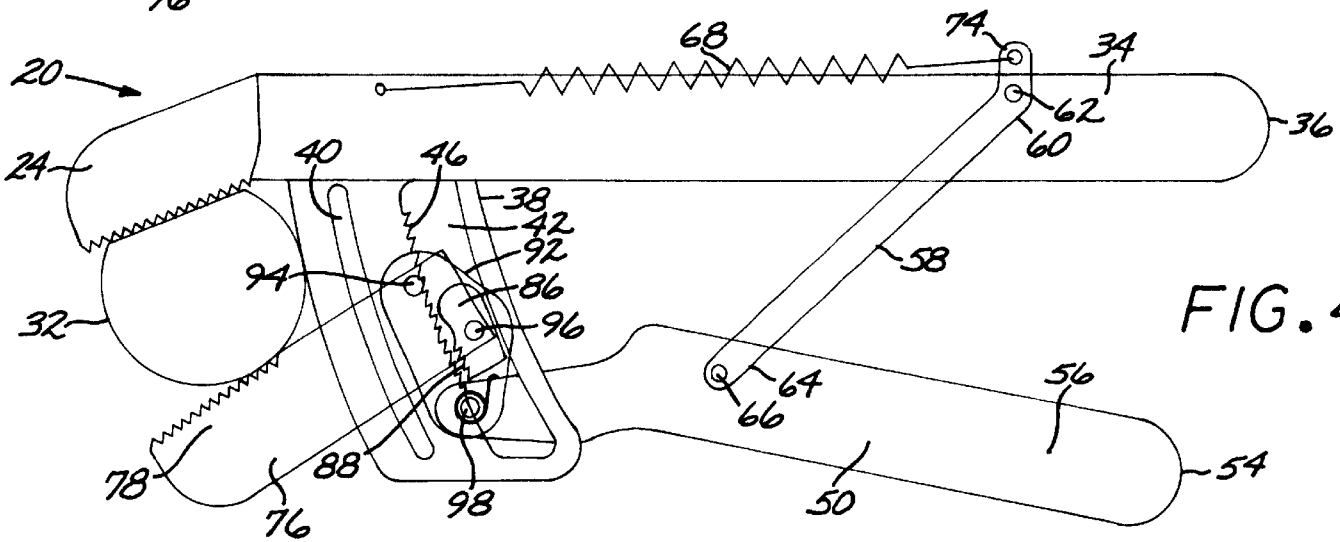
FIG. 4 is a schematic elevational view like that of FIG. 1, at the position where the lower jaw contacts the workpiece.
Figure 5:
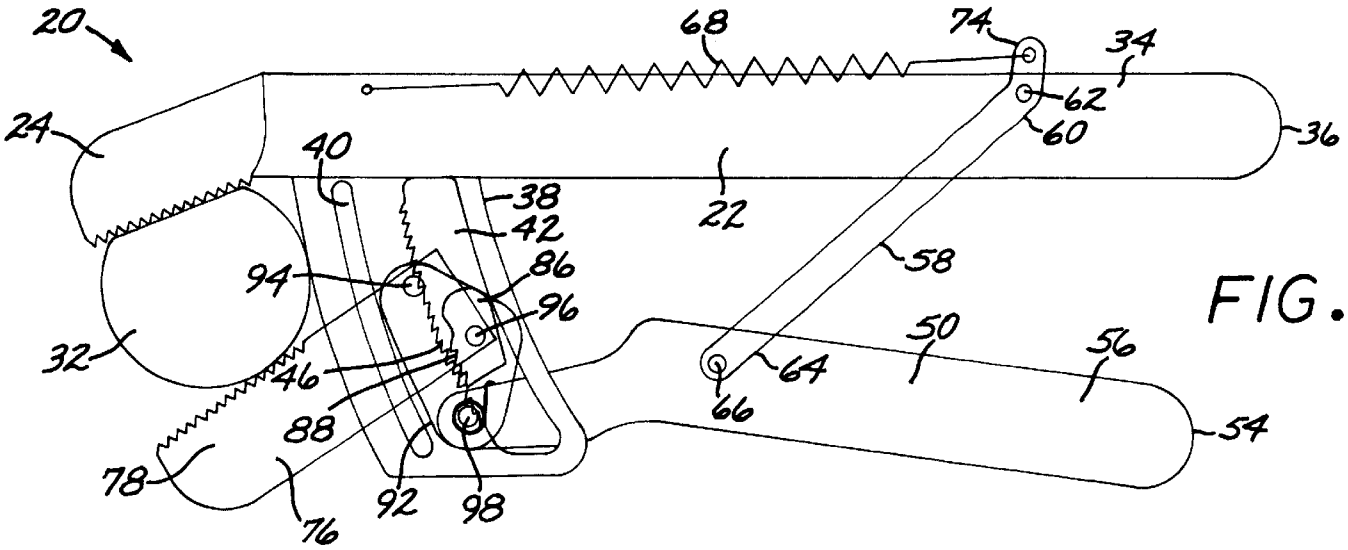
FIG. 5 is a schematic elevational view like that of FIG. 1, as force is applied to the workpiece.
Figure 6:
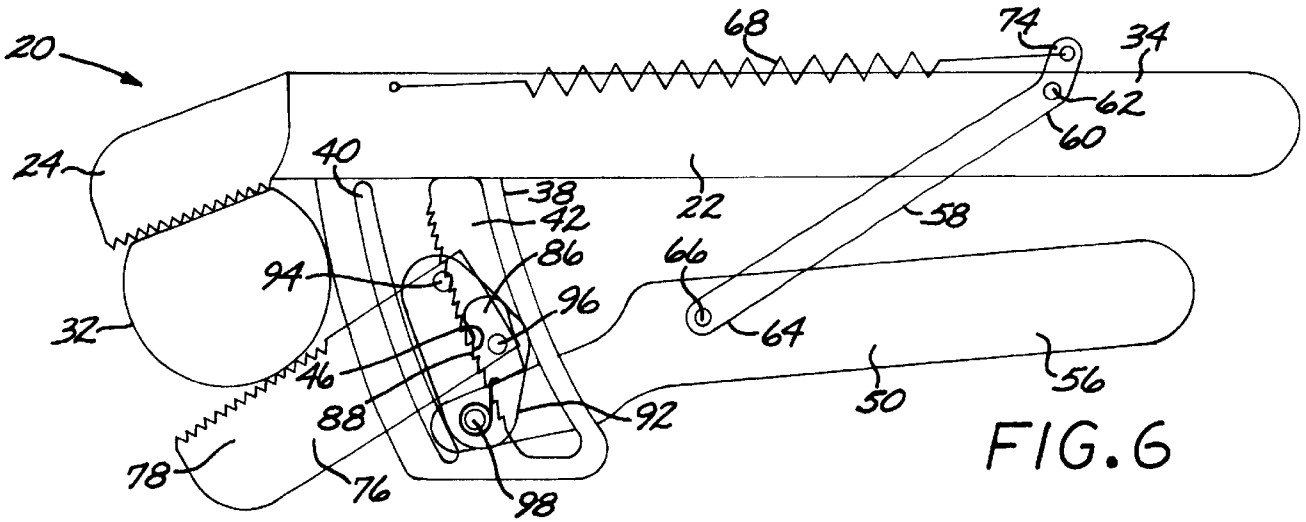
FIG. 6 is a schematic elevational view like that of FIG. 1, as the lower handle is pivoted toward an overcenter position.

FIGS. 1 and 3–6 provide a sequential depiction of the movement of the mechanism of the pliers 20 from an initial position in FIG. 1 to a near-final position in FIG. 6 as the handles are moved together with an applied force. Not all elements are shown and labeled in FIGS. 3–6, so that the operation of the mechanism is not obscured. In FIG. 1, the mechanism is in a relaxed, fully open position, with no force applied through the handles 34 and 56. The workpiece 32 is not yet grasped between the jaws 24 and 78, the slider 84 is free to slide within the first slot 40 to move the lower jaw member 76 upwardly, and the pawl 86 is free to slide within the second slot 42 with the second side 90 of the pawl 86 sliding along the second side 48 of the second slot 42.

Figure 3:
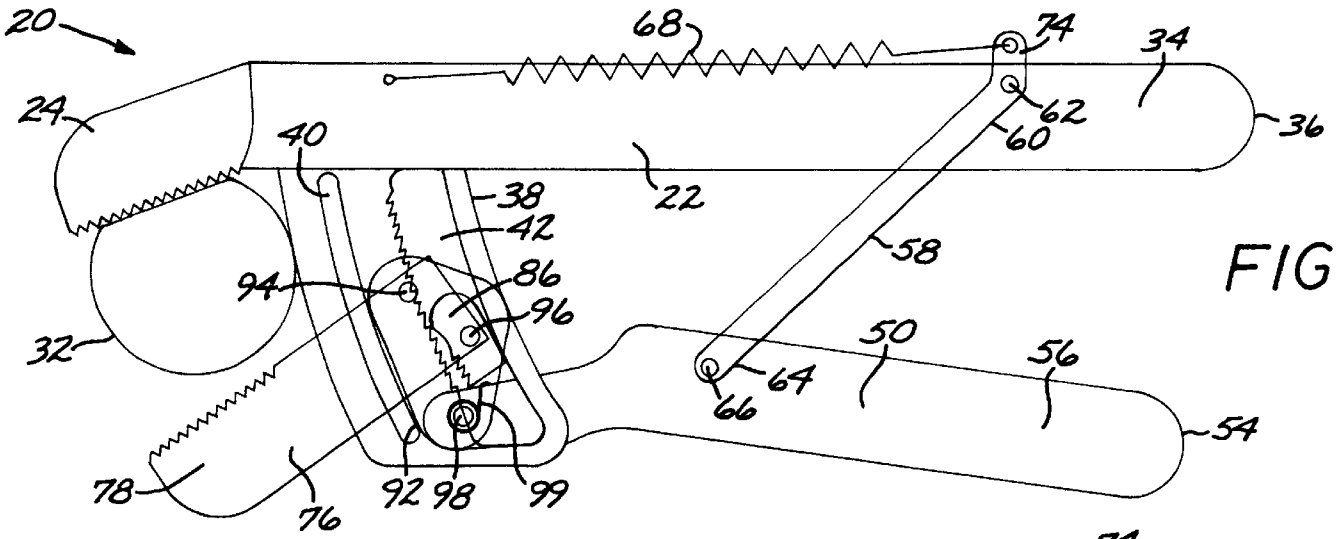
FIG. 3 is a schematic elevational view like that of FIG. 1, after initial activation of the pliers handles.

This configuration is retained, see FIG. 3, as a force is applied through the arms 22 and 50 and the lower handle 56 is moved upwardly, thereby acting through the shifter 92 to move the lower jaw member 76 upwardly to approach (but not yet reach) contact to the workpiece 32. Simultaneously, the control arm 58 pivots about the upper control arm pivot pin 62, clockwise in the view of FIG. 3, so that the spring 68 extends. The spring extension creates a relatively small force that resists the upward movement of the lower handle 56, giving the user of the pliers 20 a feel for the positioning and movement of the lower handle 56. This spring extension force also serves as a restoring force that moves the arms 22 and 50 apart to the jaw-open or relaxed position of the pliers 20 shown in FIG. 1, if no force is applied to the handles 34 and 56.

With continued upward movement of the lower handle 56, the lower jaw 78 contacts the workpiece so that it can no longer move upwardly, as seen in FIG. 4. At this point, the continued movement of the lower handle 56 causes the shifter 92 to rotate in rigid-body motion in the counterclockwise direction in FIG. 4. The rigid-body rotation of the shifter 92 draws the pawl 86 forwardly, engaging the pawl teeth 88 to the second-slot teeth 46, as seen in FIG. 5. This engagement between the sets of teeth 88 and 46 effectively produces a new clamping pivot point, whose location along the second slot 42 varies according to the size of the workpiece 32. The smaller the workpiece 32, the further upwardly along the second slot 42 is the point where the sets of teeth 88 and 46 engage. With continued upwardly movement of the lower handle 56, as in FIG. 6, the shifter 92 rotates about this effective clamping pivot point, causing the lower jaw member 76 to rotate about the clamping pivot point and, in cooperation with the upper jaw 24, to apply clamping force to the workpiece 32.

In all of this movement depicted in FIGS. 1 and 3–6, the movement of the lower jaw member 76 and its lower jaw 78 is constrained by the slider 84 to travel along the first slot 40. Also during the movement of FIGS. 1 and 3–6, the second end 64 of the control arm 58 follows a locus of points as it pivots about the upper control arm pivot pin 62. Desirably, the first slot 40 and the second slot 42 are shaped with the same curvature as this locus of points or, alternatively stated, the first slot 40 and the second slot 42 are parallel to the locus of points defined by the second end 64.

That is, in their preferred curved configuration, the first slot 40 and the second slot 42 are each respectively segments of circles centered on the upper control arm pivot pin 62. With this preferred configuration for the slots 40 and 42, the clamping force applied to the workpiece 32 is the same, regardless of the size of the workpiece 32. The closer the curvature of the slots 40 and 42 is to that of the locus of points of the second end 64 and to a segment of a circle, the closer is the clamping force to a constant value for all workpiece sizes that fit between the jaws 24 and 78. Even if the slots 40 and 42 are straight, the variation in the clamping force is relatively small, so that straight slots 40 and 42 may be used if it is not important to maintain the clamping force exactly constant for all sizes of workpieces.

Figure 7:
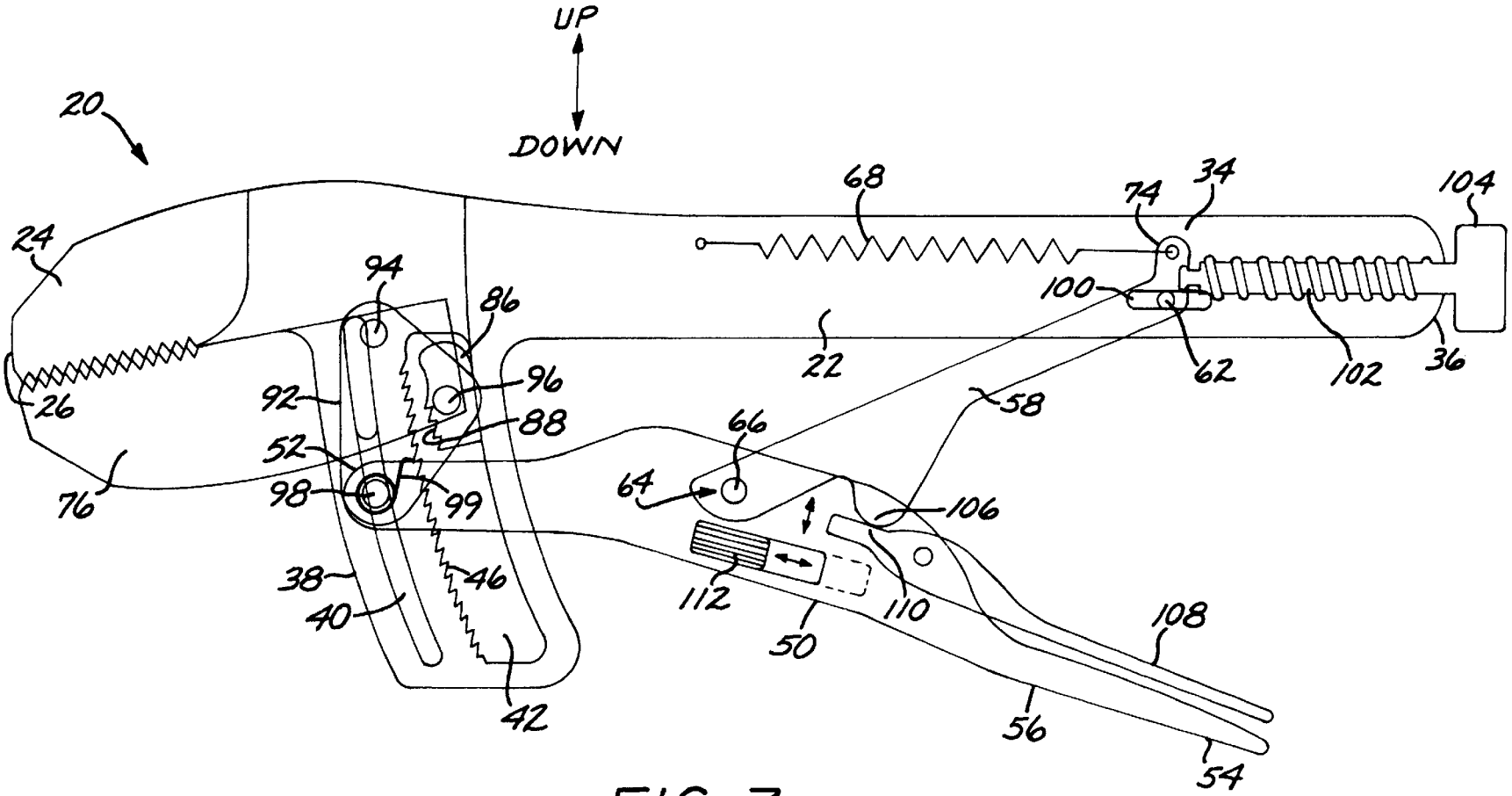
FIG. 7 is a schematic elevational view of a second embodiment of the pliers, with force adjustment and a locking release.

FIG. 7 depicts an embodiment of the pliers 20 that provides for both adjustability of the clamping force applied through the jaws 24 and 78, and also for overcenter locking and release of the clamping force. The term "overcenter locking" is used herein in the conventional sense.

These two features of force adjustability and overcenter locking and release are desirably provided together, but they may be provided separately. The basic closing and opening mode of this pliers 20 of FIG. 7 is the same as that shown in FIGS. 1–6. Features common to the embodiment of FIGS. 1–6 are identified by the same numerals, and the prior discussion of FIGS. 1–6 is incorporated herein.

The clamping force adjustability is provided by moving the upper control arm pivot pin 62 in a track 100 in the upper arm 22, along the length of the upper arm 22 in the direction between the first end 26 and the second end 36. The maximum travel required to achieve a substantial variation in the clamping force is relatively small, and typically is about ¼ inch or less. The movement of the upper control arm pivot pin 62 along the track 100 is preferably accomplished with a screw drive 102 and a manual screw movement knob 104 that extends from the second end 36 of the upper arm 22. This same adjustability may equivalently be provided by moving the lower control arm pivot pin 66 in a similar fashion, but this movement is not as conveniently implemented.

The overcenter locking and release is conveniently provided by placement of an unlocking lobe 106 on the lower side of the control arm 58. A release arm 108 is pivotably connected to the lower arm 50, at a location between the first end 52 and the second end 54 and accessible to the hand of the user of the pliers 20 at the second end 54. A release pad 110 on the upper side of the release arm 108 is disposed to contact the unlocking lobe 106. In operation, the lower control arm pivot pin 66 moves to an overcenter position relative to the upper control arm pivot pin 62 and the lower arm pivot pin 98, when the lower handle 56 is moved upwardly to the limit of its travel. Stated alternatively, when the lower handle 56 is fully open (moved to its downward limit of travel) as in FIG. 1, the lower control arm pivot pin 66 lies below a straight line drawn between the upper control arm pivot pin 62 and the lower arm pivot pin 98. As the lower handle 56 is moved upwardly, the lower control arm pivot pin 66 moves closer to a straight-line relationship between the pins 62 and 98, and eventually crosses over that straight line to lie above the straight line drawn between the pins 62 and 98. This is the overcenter lock position. To release the pliers 20 from this overcenter lock position, the release arm 108 is operated to rotate the release pad 110 upwardly against the unlocking lobe 106, and thereby force the lower arm 50 downwardly and out of the overcenter relationship.

The embodiment of FIG. 7 allows the pliers 20 to be selectively shifted between the non-locking version and the locking/release version. An overcenter lock switch 112 is provided to selectively prevent the pivoting movement of the release arm 108. That is, when the movement of the pliers 20 passes into the overcenter relationship, the release arm 108 is forced to pivot in the direction (counterclockwise in the embodiment of FIG. 7) opposite to the pivoting movement of the release arm 108 during unlocking (clockwise in FIG. 7). The locking function may be prevented by preventing this counterclockwise movement of the release arm 108 as the movement reaches the overcenter position as the jaws are closed, so that the stationary release arm 108 prevents the movement of the control arm 58 from passing to the overcenter position. The overcenter lock switch 112 prevents the movement of the release arm 108 and the control arm 58 by physically contacting and interfering with the movement of the release arm 108. Thus, in the embodiment of FIG. 7, the overcenter lock switch 112 slides into an interfering position relative to the release arm 108 when slid to the right, so that the overcenter locking is not permitted. (Other functionally equivalent forms of the overcenter lock switch may also be used, such as an arm that pivots between positions where it blocks the release arm 108 and where it does not block the release arm 108.) The pliers then serves as an ordinary non-locking pliers. When the overcenter lock switch 112 is slid to the left in the view of FIG. 7, it does not interfere with the rotation of the release arm 108, and the release arm 108 does not prevent the movement of the lobe 106 and thence the control arm 58 as it passes to the overcenter position. The pliers is a locking pliers in this configuration.

FIGS. 8–15 illustrate another embodiment of the invention. This embodiment is similar to those of FIGS. 1–7, and the description of those embodiments is incorporated herein as appropriate with differences as noted next. In these figures, the labels of some elements are omitted so as not to obscure the illustration of the movement. In the embodiment of FIGS. 8–15, the spring 68 is connected between the second end 36 of the upper arm 22 and the spring extension 74 on the control arm 58, rather than between the first end of the upper arm 22. The mechanical effect in resisting rotation of the control arm 58 is functionally the same as that of the embodiment illustrated in FIGS. 1–7, but the spring 68 is shorter and positioned out of the way so that the remainder of the upper arm 22 may be used for other purposes as will be discussed in relation to FIG. 17.

A second difference in the embodiment of FIGS. 8–15 is that a shoulder 220 extends from the side of the lower jaw 78. More preferably, two shoulders 220 are provided, one on each side of the lower jaw 78. The curvature of the shoulder 220 is matched to that of a front side 222 of the support 38. The sliding movement of the shoulder 220 over the front side 22 of the support 38 guides the position of the lower jaw 78. The front side 222 of the support 38 thereby serves as a guide for the shoulder 220 in the same manner as the first slot 40 serves as a guide for the slider 84. The shoulder 220 serves as a slider in the same sense as the slider 84, except that it slides on a surface rather than in the first slot 40. Either or both of these guides may be used. The use of both the shoulder 220 and the slider 84 provides a redundant guiding function that increases the strength of the guiding structure.

A third difference in the embodiment of FIGS. 8–15 is the addition of an arm 230 on the side of the shifter 92. The arm 230 defines a recess 232 in which is received a compression spring 234. The compression spring 234 reacts between the arm 230 on the shifter 92 and the lower arm 50. The compression spring 234 augments or replaces the coiled torsion spring 99 of the embodiment of FIGS. 1–7, to provide a greater restoring force.

A fourth difference is the addition of a stop 238 to the first end 52 of the lower arm 50. The stop 238 is positioned to engage the shifter 92 to prevent the lower arm 50 from opening (rotating clockwise in the view of FIG. 8) more widely than desired.

A fifth difference in the embodiment of FIGS. 8–15 is that the release arm 108 and its associated structure is replaced by a shaped overcenter lock switch mechanism 240, which has some of the same functionality as the release arm 108. The overcenter lock switch mechanism 240 includes a contact surface 242 at the end of an overcenter-limiting arm 244. The overcenter-limiting arm 244 is affixed to the lower arm 50 at a location adjacent to the second end 54 thereof. The overcenter-limiting arm 244 is affixed to the lower arm 50 by any operable approach, such as an illustrated slider pin 246 in a slot 248. Other affixing approaches include, for example, a hinge mechanism and a slotted receiver such as discussed above and often used at the jaw end of a conventional pliers. The movement of the overcenter-limiting arm 244 on the slider pin 246 or other affixing approach allows the overcenter-limiting arm 244, and thence the contact surface 242, to be positioned relative to the lobe 106 to allow an overcenter locking function or to prevent an overcenter locking function, depending upon the positioning. A leaf spring 250 extends between the overcenter-limiting arm 244 and the lower arm 50 to bias the overcenter-limiting arm 244 in the straight extended position.

Figures 8, 9:
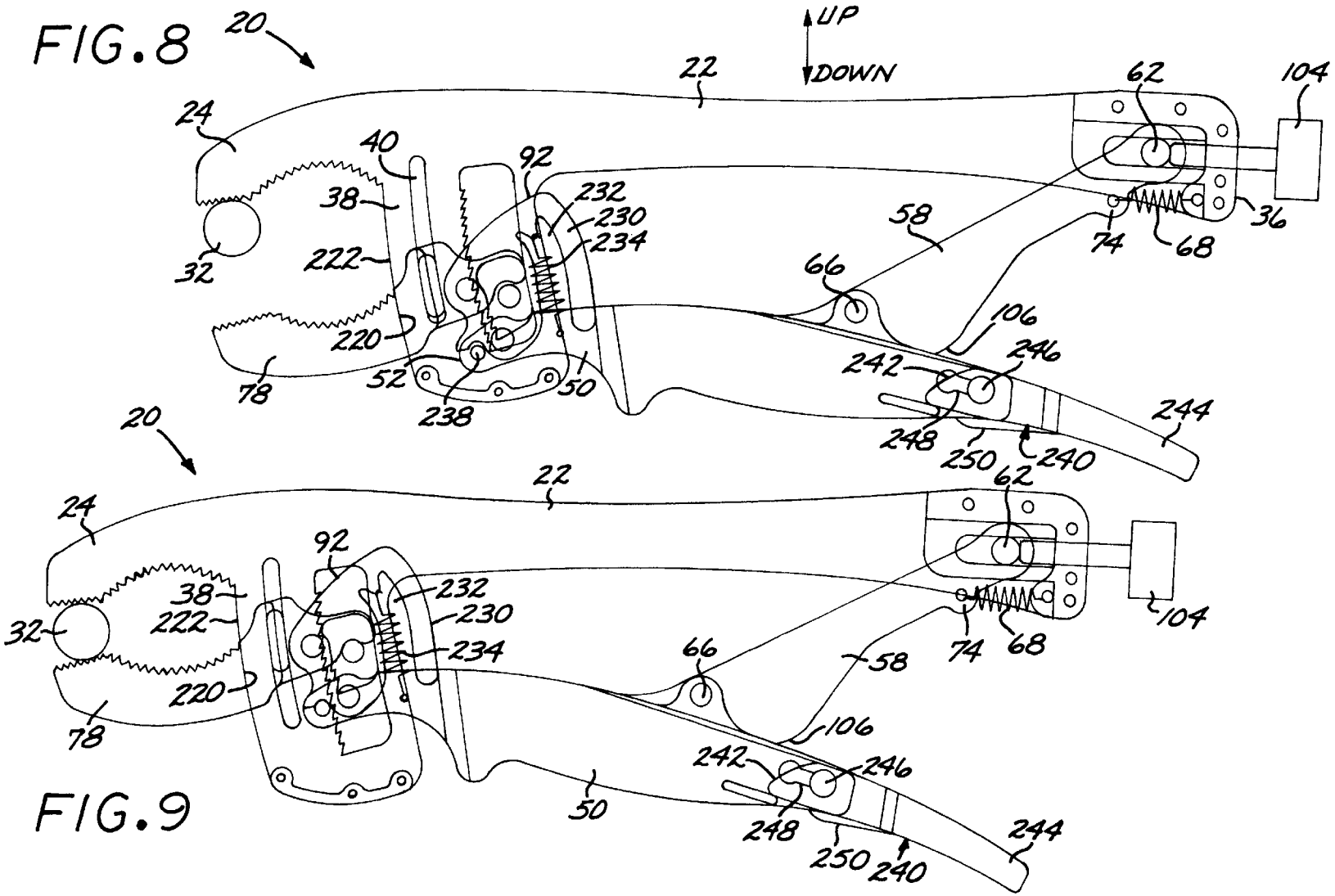
Figure 10:
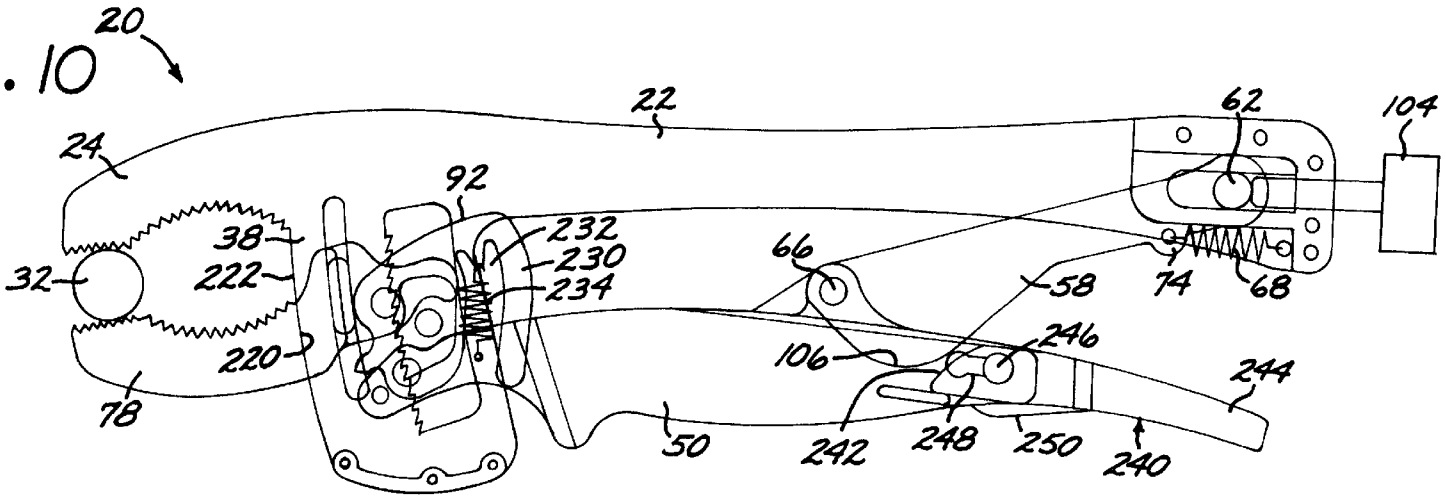
Figure 11:
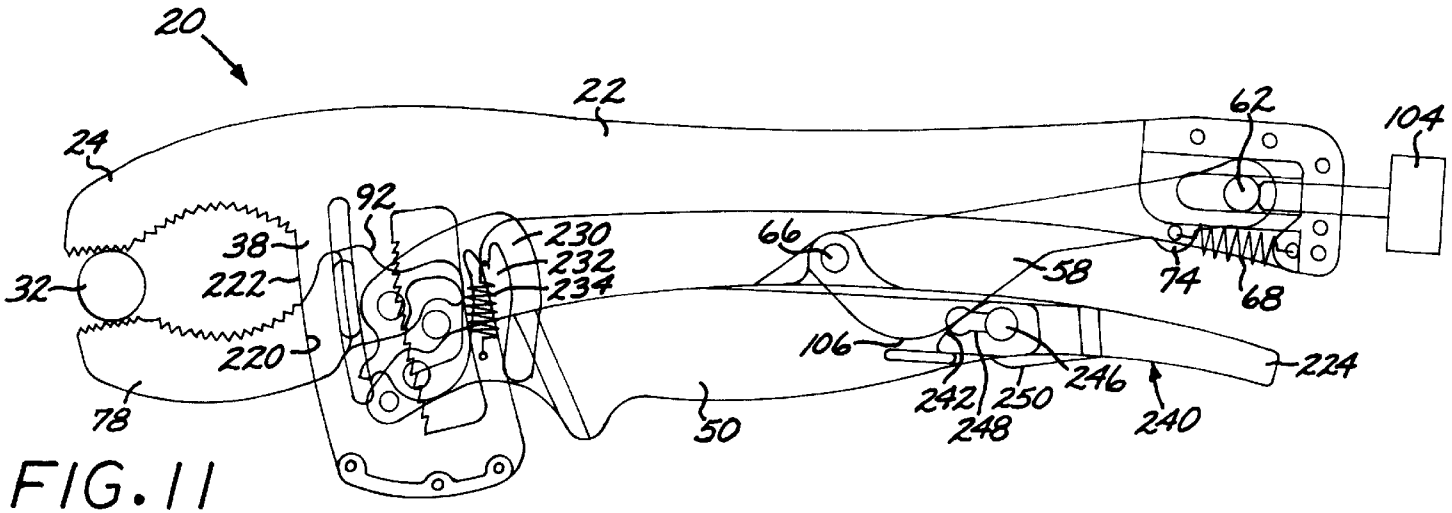
Figures 12, 13:
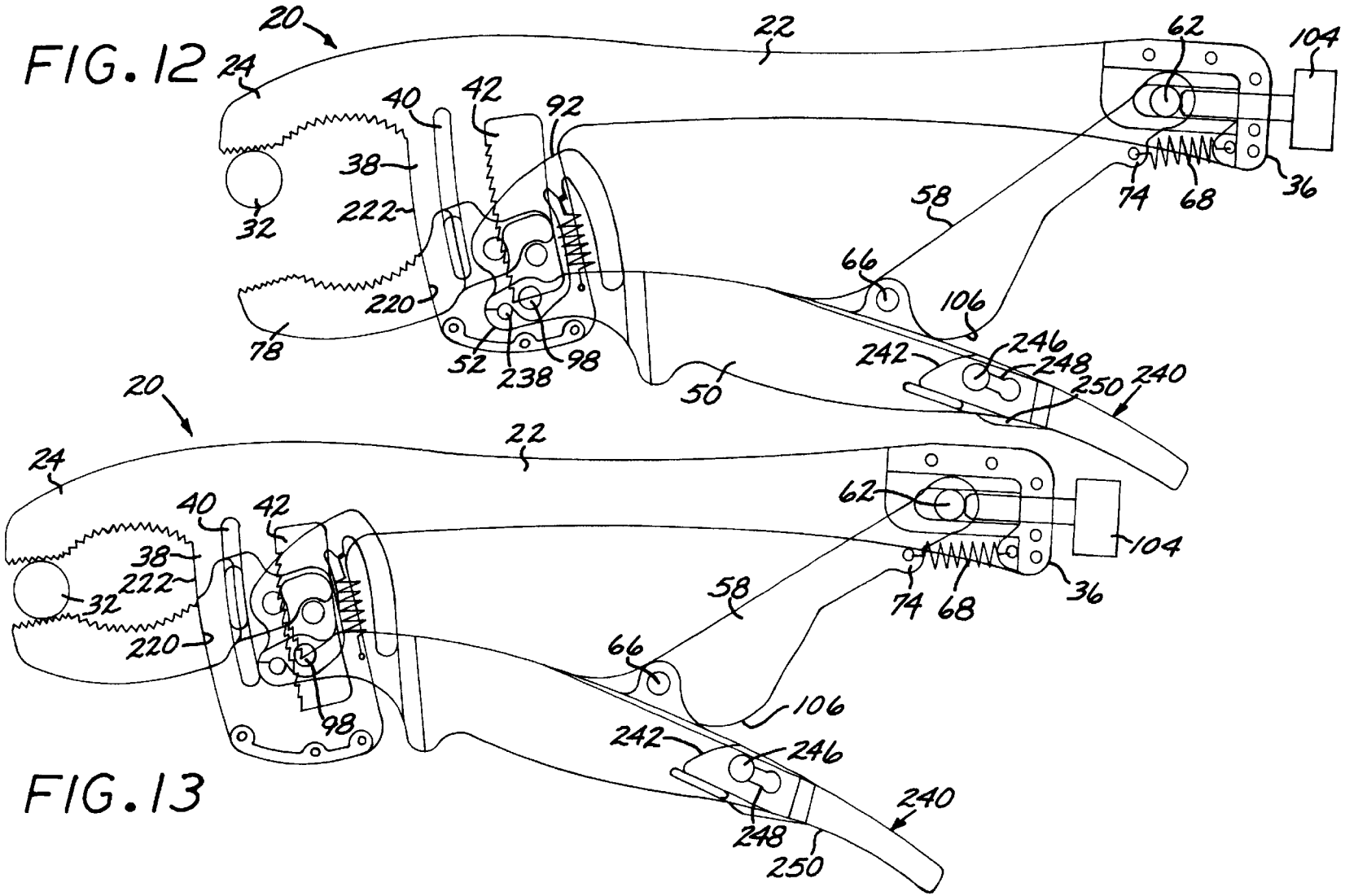
Figure 14:
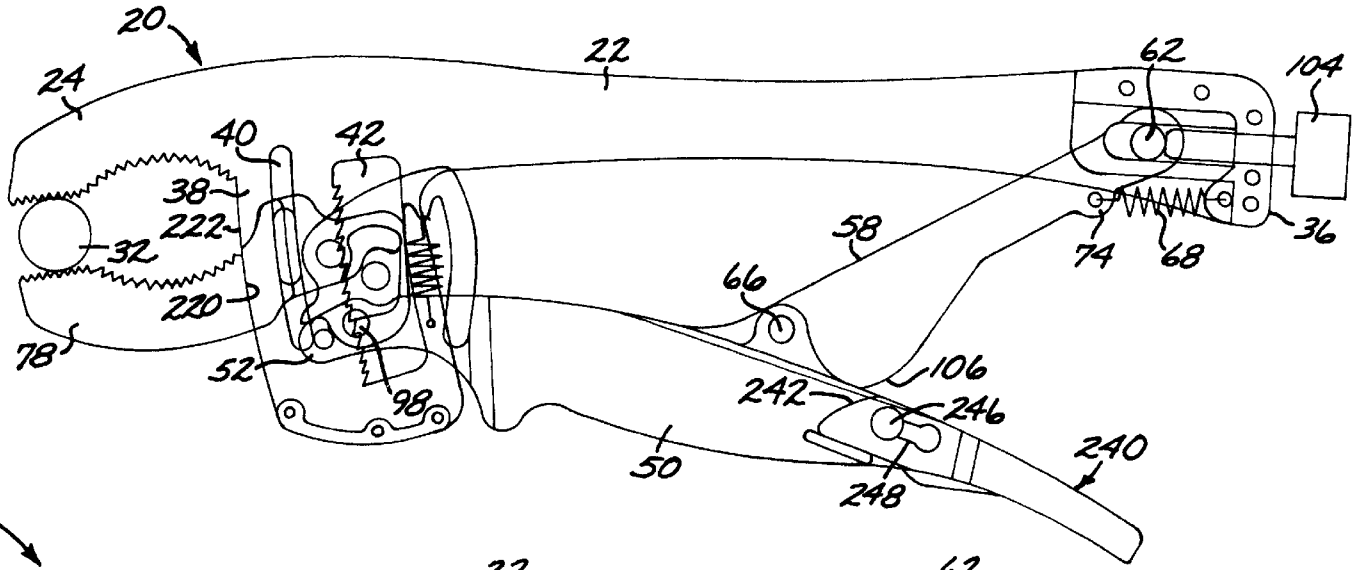
Figure 15:
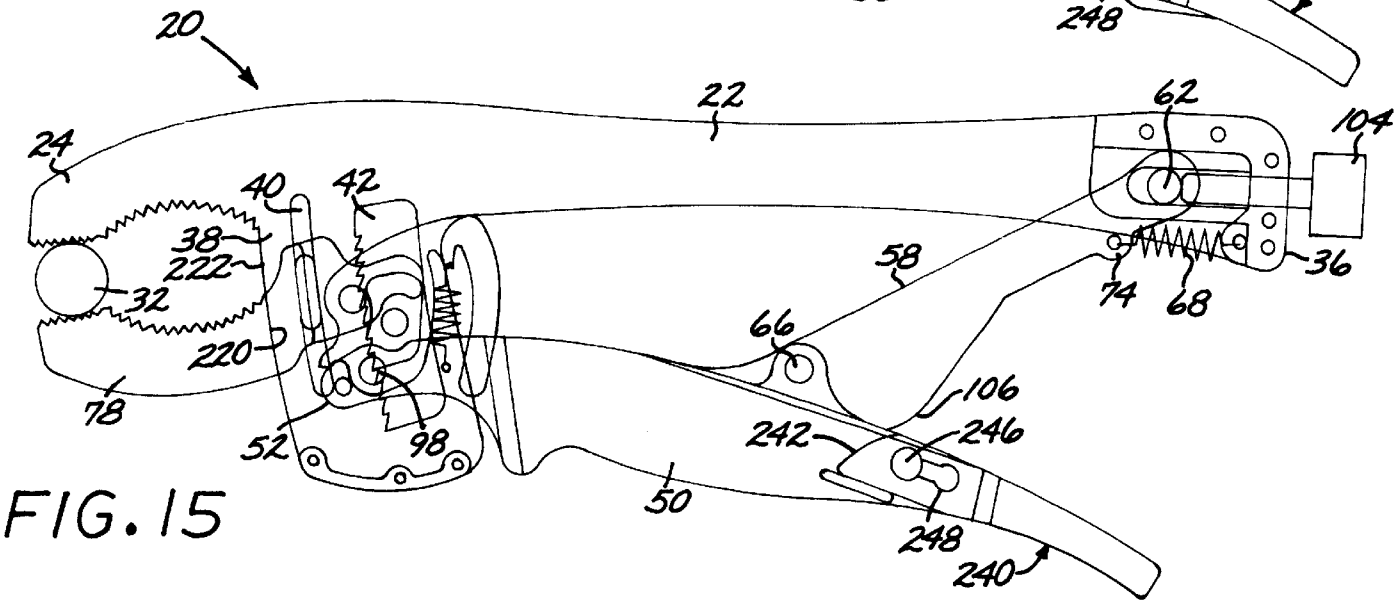

FIGS. 8–11 sequentially illustrate the operation of the pliers when the overcenter-limiting arm 244 is moved to its rearward position on the slider pin 246. In FIG. 8, the lower jaw 78 is separated from the workpiece and no force is applied through the handles 34 and 56. In FIG. 9, force is applied through the handles 34 and 56 so that the lower handle 56 is moved counterclockwise and the lower jaw 78 just contacts the workpiece. The contact surface 242 has not contacted the lobe 106. In FIG. 10, the handles 34 and 56 are squeezed together, so that a gripping load is applied to the workpiece and the lower arm 50 has moved almost, but not quite, to the overcenter position. The contact surface 242 has not contacted the lobe 106, so that in FIG. 11 the lower arm 50 may move further to the overcenter position. At this point, there is contact between the contact surface 242 and the lobe 106, so that the lower arm 50 may not move further. To unlock the overcenter position, the overcenter-limiting arm 244 is rotated against the force of the leaf spring 250, clockwise in the view of FIG. 11, to push the lower arm 50 back through the overcenter position.

FIGS. 12–15 illustrate substantially the same sequence as FIGS. 8–11, except that the overcenter-limiting arm 244 is moved to its forward position on the slider pin 246. Closing the lower handle produces a progression from the fully open position of FIG. 12, to the contacting of the lower jaw 78 to the workpiece of FIG. 13, to the near-contact of the contact surface 242 to the lobe 106 of FIG. 14, to the contacting of the contact surface 242 to the lobe 106 of FIG. 15. The contact of the contact surface 242 to the lobe 106 in FIG. 15, before the lower control arm pivot pin 66 and reaches the overcenter position, prevents movement to the overcenter position and thereby prevents the engagement of an overcenter lock.

The ability to readily switch between a pliers configuration that permits an overcenter lock, as in FIGS. 8–11, and a pliers configuration that does not permit an overcenter lock, as in FIGS. 12–15, is an important advantage. Some pliers uses, such as the initial tightening of a fitting, are best accomplished without an overcenter lock to permit the user to move the pliers quickly. Then, when the fitting is nearly tightened, the user may switch to the overcenter lock configuration to allow the final tightening to be most easily accomplished.

Figure 17:
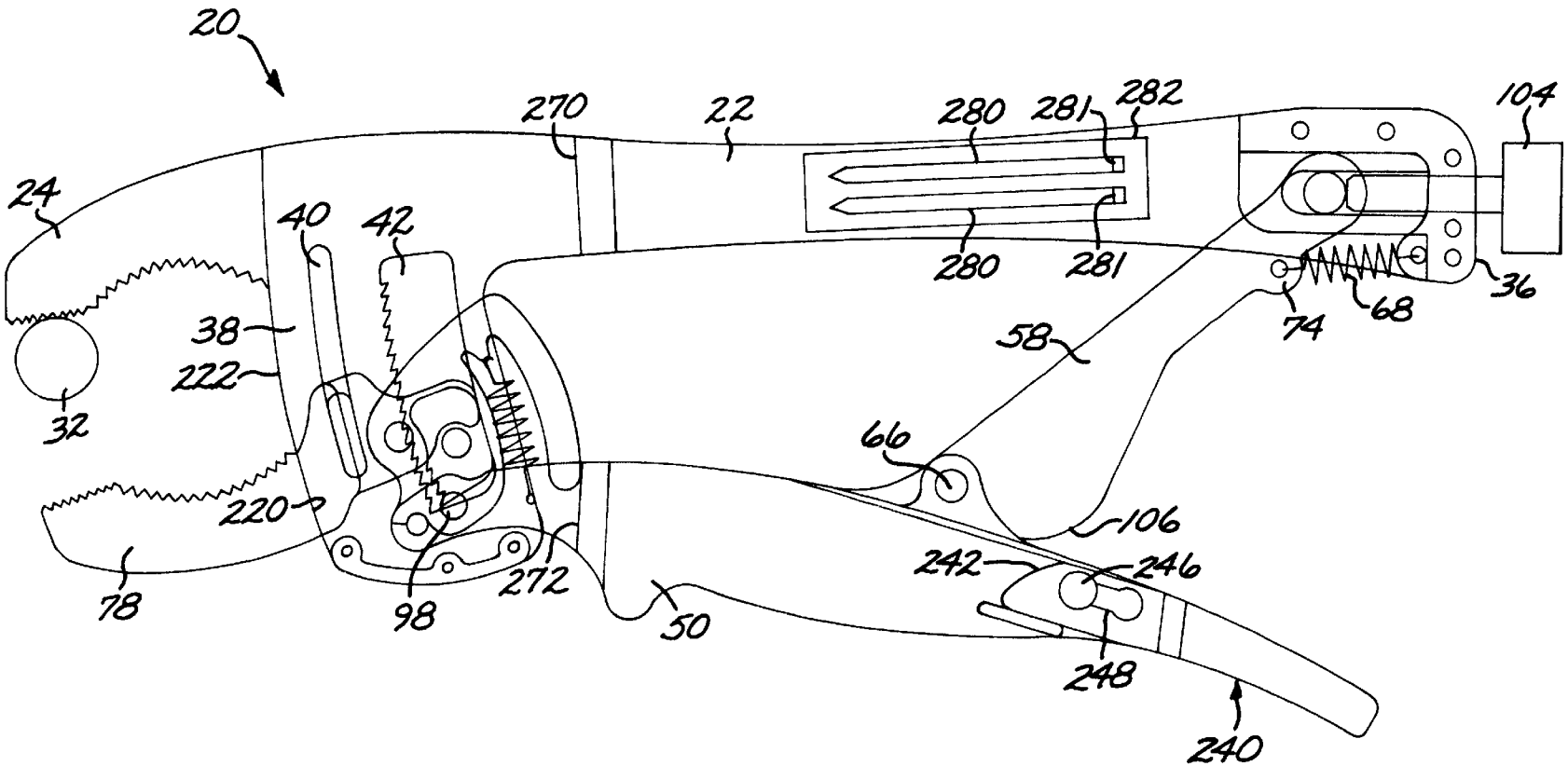
FIG. 17 is a schematic elevational view of a fifth embodiment of the pliers.

FIGS. 16–17 illustrate some other features available for use with the present approach. These embodiments are similar to those of FIGS. 1–15, and the description of those embodiments is incorporated herein as appropriate with differences as noted next. In these figures, some features are not illustrated so as not to obscure the features of interest. In FIG. 16, the slots 40 and 42 are straight, rather than curved. Also in FIG. 16, the second slot 42 and the pawl 86 are not provided with teeth. Instead, a layer of a high-friction material 260 is applied to one or both of the facing surfaces of the second slot 42 (i.e., its first side 44) and the pawl 86 to permit them to engage each other upon tightening of the grip, instead of having teeth engage each other. The approach of FIG. 16 using the high-friction material 260 produces an infinite degree of resolution of the engagement mechanism of the pawl 86 to the second slot 42, although the engagement is not as secure as where teeth are used. In yet another alternative, a friction-cam lock may be used, wherein the pawl 86 or other movable element serves as a cam to engage the side of the second slot 42.

In FIG. 17, the upper arm 22 is provided with an upper-arm pivot hinge 270 at an intermediate position along its length. The lower arm 50 is similarly provided with a lower-arm pivot hinge 272 at an intermediate position along its length. The pivot hinges 270 and 272 allow the respective arms 22 and 50 to pivot between the illustrated open position and a folded or closed position to make the pliers 20 more compact.

Also shown in FIG. 17 is at least one auxiliary tool 280 hingedly connected to one of the upper arm 22 and the lower arm 50 and rotatable in either a clockwise or counterclockwise direction according to the nature of the hinge. In the illustration, two auxiliary tools 280 are pivotably connected to the upper arm 22 by respective hinges 281. These auxiliary tools 280 may optionally be received within a recess 282 within the arm 22 or 50, so that they may fold to a closed position below its surface. The auxiliary tools 280 may include, for example, screwdrivers, awls, blades, or the like.

A prototype of the pliers 20 has been constructed with the features of FIGS. 8–15. The pliers 20 functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A self-adjusting pliers, comprising:

an upper arm including an upper jaw at a first end thereof, an upper handle adjacent to a second end thereof, a support extending downwardly from an intermediate location thereof between the first end and the second end, a downwardly extending guide on the support, and a downwardly extending slot on the support, the downwardly extending slot being parallel to the downwardly extending guide;

a lower arm including a first end, and a lower handle at a second end thereof;

a control arm pivotably connected at a first end to the upper arm at an upper control arm pivot pin located adjacent to the second end of the upper arm, and at a second end to the lower arm at an intermediate location between the first end and the second end thereof;

a spring affixed between the upper arm and the control arm so as to resist rotation of the control arm;

a lower jaw member including a lower jaw at a first end thereof, the lower jaw being in a facing relationship to the upper jaw, and a slider extending from a side of the lower jaw member, the slider being slidable on the guide of the support;

a locking engagement disposed to controllably engage the downwardly extending slot upon pivoting movement of the lower handle to an overcenter position; and a shifter having three pivot points arranged in a triangular pattern, the three pivot points being respectively connected to the lower jaw member, to the locking engagement, and to the first end of the lower arm.

2. The pliers of claim 1, wherein the guide and the slot are straight.

3. The pliers of claim 1, wherein the guide and the slot are curved.

4. The pliers of claim 1, wherein the guide and the slot are each curved with respective curvatures of substantially constant radius from the upper control arm pivot pin.

5. The pliers of claim 1, further including a manual adjuster acting on the control arm at a location adjacent to its first end, and operable to move the first end of the control arm in a direction along the length of the upper arm between the first end and the second end of the upper arm.

6. The pliers of claim 1, further including a downwardly extending lobe on the control arm, and a release arm pivotably connected to the lower arm and having a release pad disposed to contact the lobe of the control arm when the release arm is pivoted.

7. The pliers of claim 1, further including an overcenter lock switch mechanism in the lower handle movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching an overcenter lock.

8. The pliers of claim 7, wherein the overcenter lock switch mechanism is slidably or rotatably movable.

9. A self-adjusting pliers operable to grasp a workpiece between an upper jaw and a lower jaw, comprising:

an upper arm having the upper jaw;

a lower arm, the lower jaw being linked to the lower arm but not integral with the lower arm;

a control arm having a first end and a second end, the first end of the control arm having a first pivotable connection to the upper arm adjacent to an end of the upper arm remote from the upper jaw, and the second end of the control arm having a second pivotable connection to the lower arm at an intermediate location along the length of the lower arm;

an upper control arm pivot pin providing the pivotable connection between the first end of the control arm and the upper arm;

a spring connected between the upper arm and the control arm, the spring biasing the control arm so as to resist rotation of the control arm about the upper control arm pivot pin; and a support extending downwardly from the upper arm toward the lower arm, the support having a guide thereon, the lower jaw slidably engaging the guide such that the lower jaw is constrained to follow the guide when the lower arm is pivoted about the upper control arm pivot pin.

10. The pliers of claim 9, further including a downwardly extending slot on the support, the slot being separate from the guide but parallel to the guide, and a guide mechanism engaged between the lower jaw, the guide, and the slot, the guide mechanism being operable to slide the lower jaw along the guide and the slot until it contacts the workpiece, responsive to a pivoting movement of the lower arm on the control arm about the first end of the control arm.

11. The pliers of claim 10, wherein the guide mechanism is further operable to lock the lower jaw to the downwardly extending slot.

12. The pliers of claim 9, wherein the guide comprises a guide slot.

13. The pliers of claim 9, further including a manual adjuster operable to move the upper control arm pivot pin in a direction along a length of the upper arm.

14. The pliers of claim 9, further including a downwardly extending lobe on the control arm, and a release arm pivotably connected to the lower arm and having a release pad disposed to contact the lobe of the control arm when the release arm is pivoted.

15. The pliers of claim 9, further including an overcenter lock switch mechanism in the lower handle movable between a first position whereat the overcenter lock switch mechanism does not prevent pivoting movement of the lower arm relative to the control arm prior to reaching an overcenter lock, and a second position whereat the overcenter lock switch mechanism does prevent pivoting movement of the lower arm relative to the control arm prior to reaching an overcenter lock.

16. The pliers of claim 10, wherein the guide mechanism further comprises:

a locking engagement disposed to controllably engage the downwardly extending slot responsive to pivoting movement of the lower handle to an overcenter position, and a shifter having three pivot points arranged in a triangular pattern, the three pivot points being respectively connected to the lower jaw member, to the locking engagement, and to a first end of the lower arm.

17. The pliers of claim 9, wherein the upper arm and the lower arm each include an intermediate hinge therein so as to be foldable.

18. The pliers of claim 9, further including an auxiliary tool pivotably connected to one of the upper arm and the lower arm.

* * * * *

UNITED STATES PATENT AND TRADEMARK OFFICE

CERTIFICATE OF CORRECTION

PATENT NO. : 6,279,431 B1
DATED : August 28, 2001
INVENTOR(S) : Brett P. Seber and Eric B. Carmichael It is certified that error appears in the above-identified patent and that said Letters Patent is hereby corrected as shown below:

Title page,
The following references are to be added as References Cited

-- U.S. PATENT DOCUMENTS

| | | |
|---|---|---|
| 4,541,312 | 9/1985 | Petersen |
| 4,651,598 | 3/1987 | Warheit |
| 4,662,252 | 5/1987 | Warheit |
| 5,020,399 | 6/1991 | Annis et al. |
| 4,922,770 | 5/1990 | Dlugolecki et al. |
| 5,408,904 | 4/1995 | Neff |
| 4,802,390 | 2/1989 | Warheit |
| 4,730,524 | 5/1988 | Petersen -- |

Signed and Sealed this

Second Day of April, 2002

*Attest:*

*Attesting Officer*

JAMES E. ROGAN
*Director of the United States Patent and Trademark Office*